United States Patent [19]

Hahn

[11] 4,235,201

[45] Nov. 25, 1980

[54] SAFETY TOPDECK FOR BOILERS

[76] Inventor: Richard C. Hahn, 2111 Adams Blvd., Saginaw, Mich. 48602

[21] Appl. No.: 961,287

[22] Filed: Nov. 16, 1978

[51] Int. Cl.[3] ..... F22B 37/36

[52] U.S. Cl. ..... 122/494; 122/510; 105/358

[58] Field of Search ..... 122/149, 494, 510; 248/676, 678; 105/457–459, 358, 360; 296/183, 182

[56] References Cited

U.S. PATENT DOCUMENTS

| | | | |
|---|---|---|---|
| 1,033,355 | 7/1912 | Stanwood | 122/494 |
| 1,056,053 | 3/1913 | Priebe | 105/457 |
| 1,228,378 | 5/1917 | Brown | 122/494 |
| 1,393,402 | 10/1921 | Shepard et al. | 122/494 |
| 1,831,810 | 11/1931 | Jones | 105/457 |
| 2,099,740 | 11/1937 | Kieselbach | 122/494 |
| 3,084,638 | 4/1963 | Allegrette | 105/457 |
| 3,599,575 | 8/1971 | Yurkoski | 105/358 |
| 3,662,692 | 5/1972 | Price et al. | 105/358 |
| 3,766,862 | 10/1973 | Heap et al. | 105/360 |

*Primary Examiner*—Henry C. Yuen
*Attorney, Agent, or Firm*—John J. Swartz

[57] ABSTRACT

A safety topdeck for a boiler having a cylindrical shell including a generally horizontal walkway and a frame for supporting the walkway on the cylindrical shell comprising laterally spaced apart, generally upstanding support legs and mechanism for mounting the support legs to opposite sides of the cylindrical shell.

4 Claims, 6 Drawing Figures

SAFETY TOPDECK FOR BOILERS

BACKGROUND OF THE INVENTION

This invention relates to boilers and more particularly to a flat top deck for a horizontal firetube type steam generator.

Steam generators have been provided heretofore such as that disclosed in U.S. Pat. No. 1,908,547. Such steam generators typically include a horizontal, cylindrical boiler receiving horizontal firetubes through which products of combustion pass in a circuitous path to heat water disposed in the cylinder. Such boilers typically include water level control lines, and safety valves, and exhaust stacks, along the upper side thereof, which periodically require servicing. Various state legislatures have enacted boiler safety acts which mandate that certain boilers with round tops shall be provided with a permanent platform providing access to the valves atop the boiler. To conform with such boiler safety acts, a structural steel platform which sets on the floor adjacent the boiler, or is suspended from the ceiling, has been utilized heretofore. Such prior art devices are relatively expensive and complicate, rather than simplify, the service access problem. The danger of standing on top of such a platform is compounded by the necessity of reaching the safety platform.

Accordingly, it is an object of the present invention to provide a new and novel safety top deck for a horizontal, firetube type steam generator.

Another object of the present invention is to provide an acceptable, safety topdeck which is mounted on the boiler and is supported thereby.

Another object of the present invention is to provide a safety platform for boilers which will not substantially increase the overall height or width of the unit to minimize shipping and installation problems.

Still another object of the present invention is to provide a boiler including a frame mounting a walkway on the cylindrical shell of a horizontal cylindrical boiler.

Other objects and advantages of the present invention will become apparent to those of ordinary skill in the art as the description thereof proceeds.

SUMMARY OF THE INVENTION

A safety topdeck for a boiler including a generally horizontal, longitudinally extending, cylindrical shell, comprising: a generally horizontal walkway; and a frame for supporting the walkway on the cylindrical shell comprising laterally spaced apart, generally upstanding support legs and mechanism for mounting the support legs to opposite sides of the cylindrical shell.

The present invention may more readily be understood by reference to the accompanying drawings in which.

DESCRIPTION OF THE INVENTION

Figure 1:
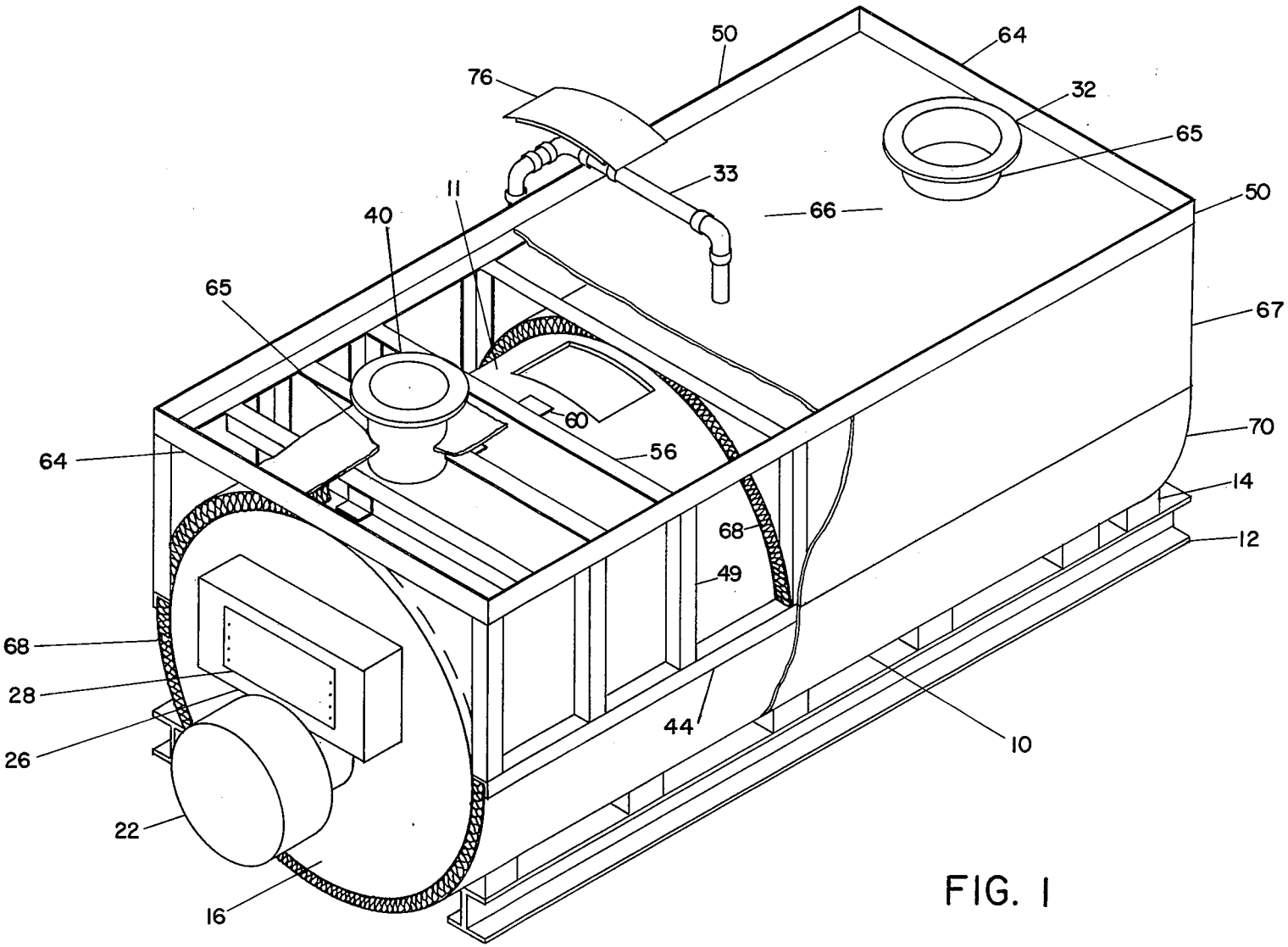
FIG. 1 is an isometric view of apparatus constructed according to the present invention, a portion of the decking and side covering being removed to more particularly illustrate the underlying framework.
Figure 3:
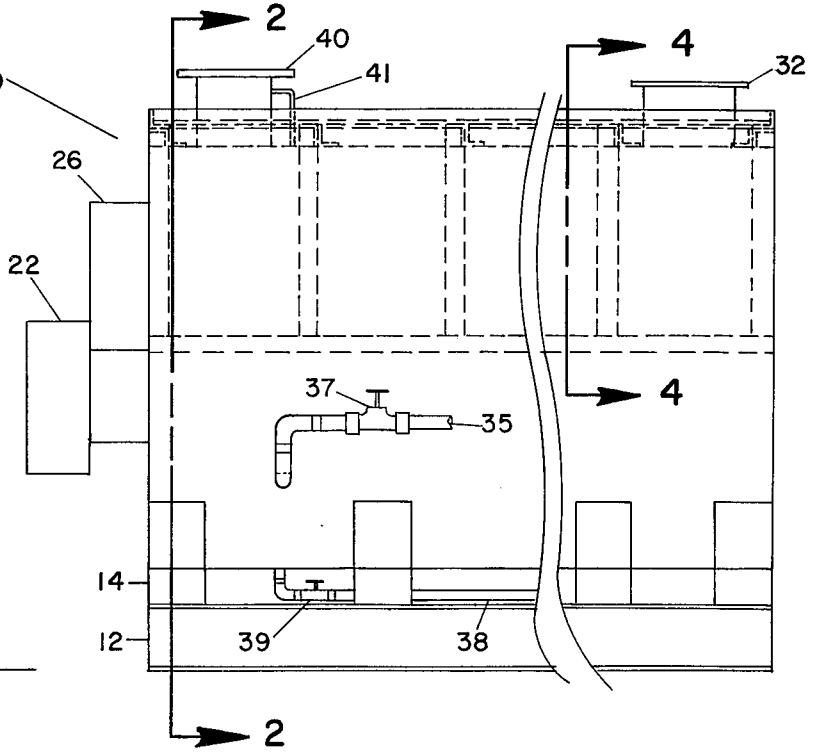
FIG. 3 is a side elevational view thereof.

A three-pass, horizontal, firetube steam generator boiler, generally designated 10, is mounted on a boiler base, generally designated 12, via shell supports 14. The base 12 and shell supports 14 may typically comprise structural steel. The boiler 10 includes a cylindrical shell 11 closed by end plates or front and rear tube sheets 16 and 18. The boiler shell 11 is typically fabricated with carefully controlled, rolled sheet steel, which meets or exceeds the minimum design standards of the ASME code. A hollow, cylindrical firetube 20 is mounted within the cylindrical shell 11 and is coupled to a gas burner, generally designated 22, mounted on the outside of the front endwall 16. Coupled to the firetube 20 are a plurality of hollow, cylindrical flue tubes 24 which are mounted within the shell 11, above firetube 20, and pass products of combustion from the firetube 20 to a manifold 26 mounted on the outside of front endwall 16. The manifold 26 includes externally opening, swingable inspection doors 28 for permitting inspection and tube cleaning.

One or more additional, hollow, cylindrical flue tubes 30 are disposed within the cylindrical shell 11, above the flue tubes 24, and are coupled to the manifold 26, and an exhaust stack 32 mounted adjacent the rear endwall 18 to permit the products of combustion to pass outwardly to atmosphere via the exhaust stack 32. A control water inlet conduit 33 is provided in the sidewall of the cylindrical shell 11. The cylindrical shell 11 is filled with water W to a level 34 which is below the top of shell 11 a sufficient distance to provide an ample steam storage space or chamber 36 between the surface of water W and at the uppermost end of the cylindrical shell 11. Water outlet tubes 38 including control valves 39 may typically be provided along the lower wall of the shell 12 for discharging water from the shell 11. A water level controller, generally designated C, is coupled between the shell sidewall, at a level below the level of water W, and the topwall of the shell 11. Steam outlet tubes 40, including pressure sensitive control valves schematically illustrated at 42, are provided in the upper end of the shell 11 for controlling the pressure which builds in the chamber 36. The control valves 42 are electrically coupled via an electrical line 41 to a pressure senser 43 mounted in the chamber 36 which senses the pressure within shell 11. An inspection opening O is provided in the topwall of shell 11 covered by a removable cover C. The structure heretofore described is entirely conventional.

Figure 4:
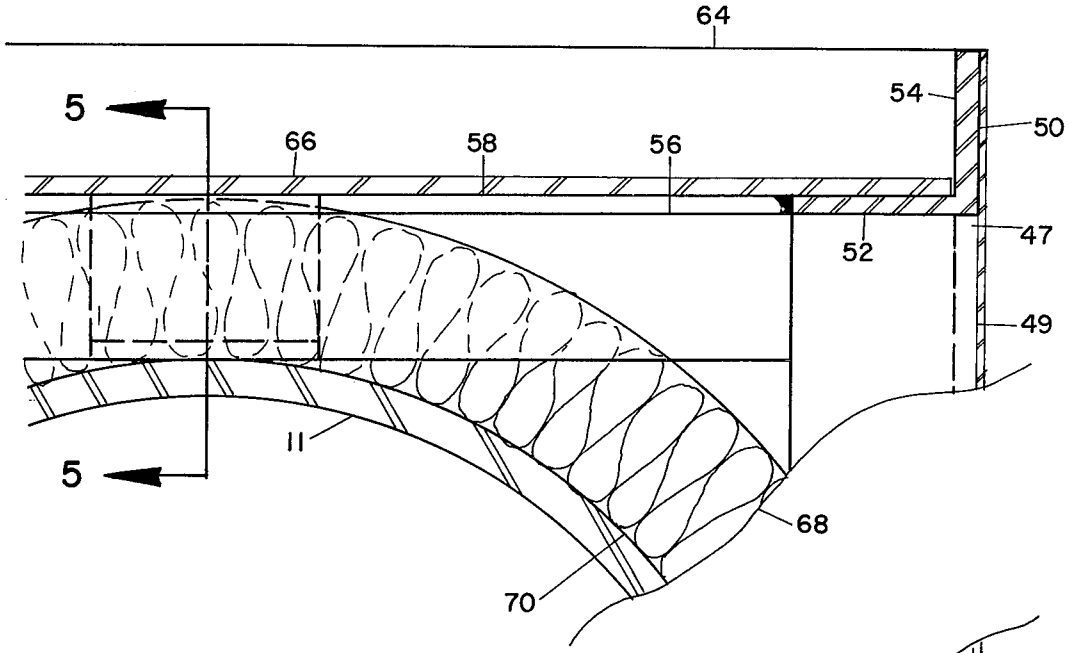
FIG. 4 is a greatly enlarged sectional end view, taken along the line 4—4 of FIG. 3.
Figure 4:
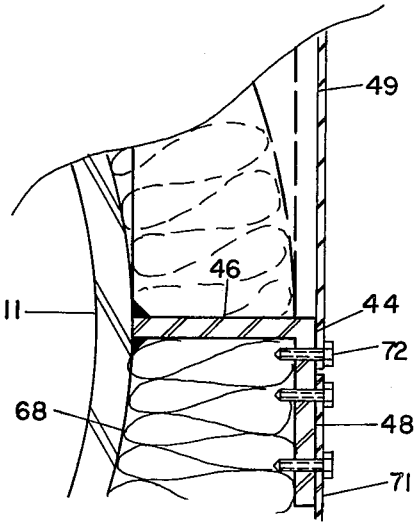
Figure 5:
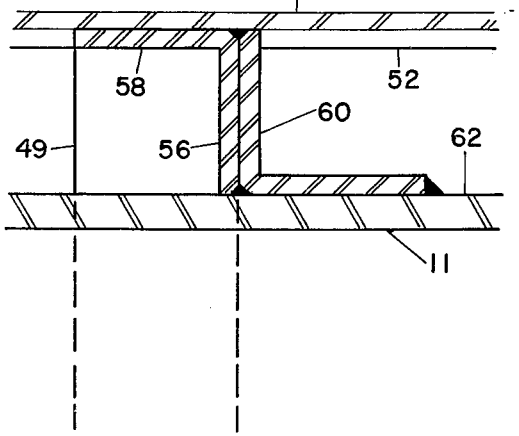
FIG. 5 is a sectional side view, taken along the line 5—5 of FIG. 4.
Figure 6:
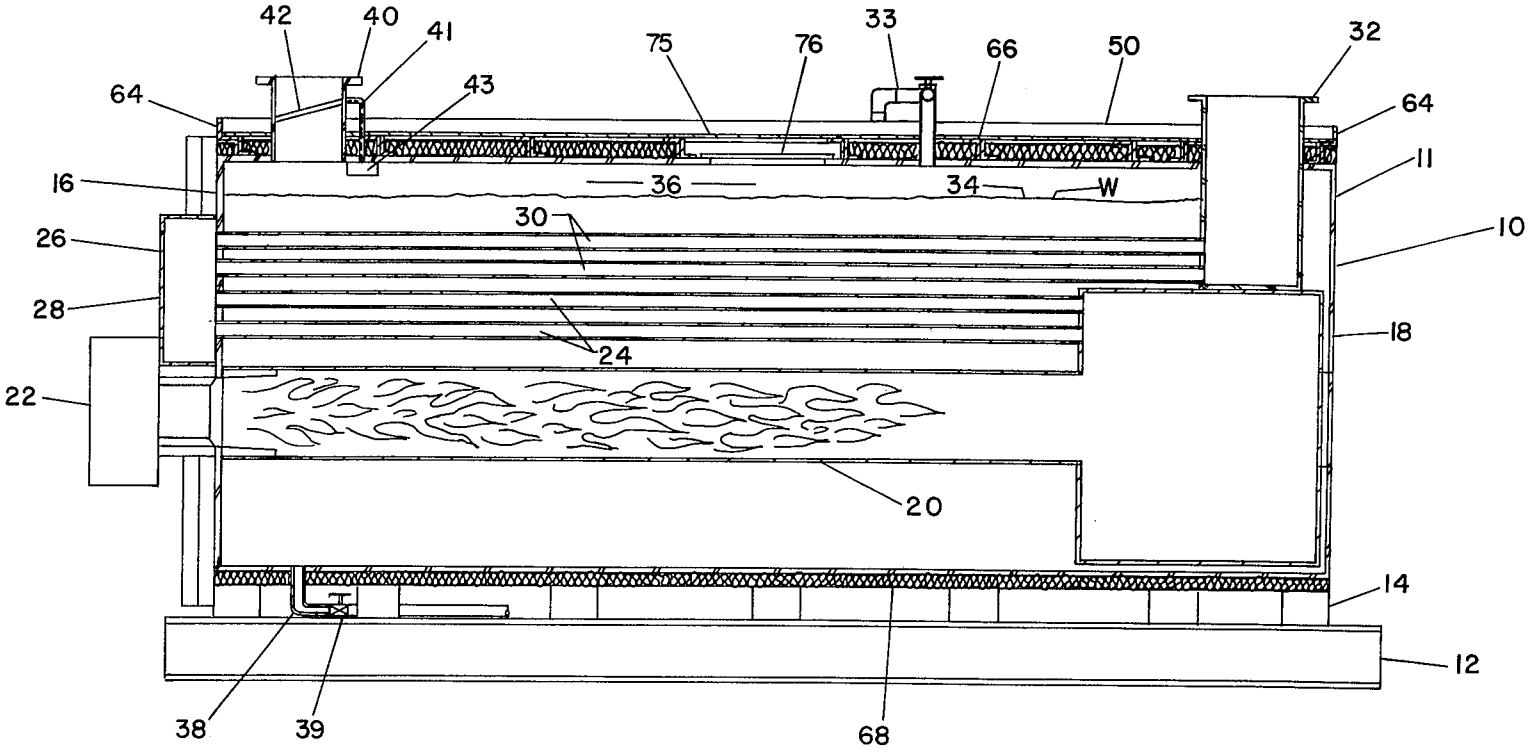
FIG. 6 is a sectional side view, taken along the line 6—6 of FIG. 2.

Welded, or otherwise suitably secured, to diametrically opposite sides of the cylinder 11 are longitudinally extending, radially outwardly projecting angle irons, generally designated 44, having a horizontal portion 46 and a generally vertically extending, terminal flange portion 48. Mounted on the horizontal flange portions 46 are a plurality of longitudinally spaced, vertical support legs 49 including upper ends 47 spanned by longitudinally extending, angle irons 50. As illustrated in FIGS. 1 and 4, the angle irons 50 include a horizontally disposed flange portion 52 welded or otherwise suitably secured to the upper leg ends 47, and a generally vertically extending flange portion 54. A plurality of laterally extending, longitudinally spaced apart brace members 56 span the upper side members 50 and include a vertical flange portion 56 and an upper, horizontal flange portion 58 (FIG. 5). The cross brace members 56 are fixed to the upper end of the shell 12 via a plurality of longitudinally spaced angle iron brackets 60 which are welded to the top 62 of the shell 11 as well as being welded, or otherwise suitably fixed, to the vertical flange portions 56. A plurality of longitudinally spaced, laterally extending end frame members 64, constructed identically to the side frame members 50, span the opposite ends of the side frame members 50. The side frame members 50 and end frame members 64 form an upwardly opening tray for receiving a flat top deck plate, generally designated 66. The flat top deck plate or walkway 66 is supported by the horizontal flange portions 52. The flat top deck plate 66 has openings 65 cut therein for receiving the steam outlet conduit 40, and the exhaust stack 32 and the inspection cover C. The deck plate 66 also includes a removal hatch 75 for providing access to a removable access cover 76 provided in the top wall of shell 12. Removal of hatch 75 and cover 76 permits inspection inside the shell 12. Side cover sheets 67 and 69 span the upper and lower angle irons 44 and 50. Lateral and endwise movement of the tray 66 is inhibited by the vertical flanges 54 of side and end from members 50 and 64.

The flanges 54 of side frame members 50 and end frame members 64 are disposed upwardly to act as a retaining "boss" for the top deck plates 66. The flanges 54 also function to keep any service tools from accidentally being kicked off the top deck edge at the peril of those at floor level walking beside the boiler.

Deck plate 66 may be provided in individual sections so as to facilitate its convenient removal for periodic regional servicing of functional boiler top elements.

Figure 2:
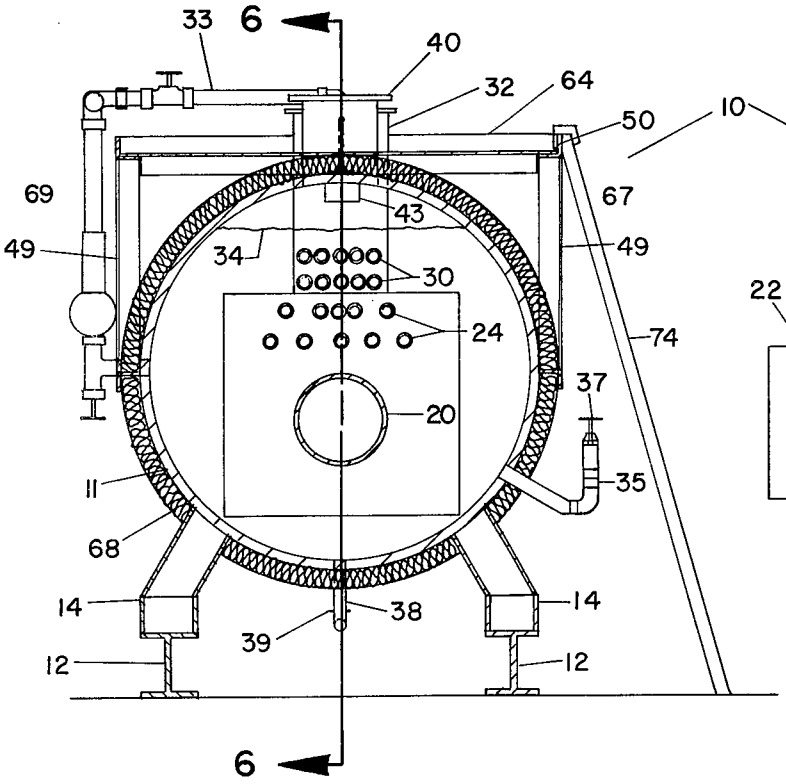
FIG. 2 is a front end sectional view, taken along the line 2—2 of FIG. 3.

As illustrated in FIGS. 2 and 4, a layer 68 of thermal insulating material envelops the entire outer surface 70 of the shell 11. A protective skin or wrapper layer 71, which may suitably comprise a thin layer of metal, is provided on the underside of the insulation 68 and is fixed to the vertical legs 48 via screws 72. A ladder 74, similar to a ladder found on a bunk bed, is provided for providing access to the top of the structure as illustrated in FIG. 2.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. In combination with a boiler, including a generally horizontal, longitudinally extending, hollow, cylindrical shell having a cylindrical sidewall:

a layer of insulation enveloping the outer surface of said shell;

a walkway overlying said shell and said layer of insulation;

frame means for mounting said walkway on said shell including:

radially outwardly projecting support members fixed to opposite sides of said sidewall; and upstanding support means mounted on said radially outwardly projecting support members;

a layer of protective material enveloping the lower portion of said layer of insulation; and means coupling said layer of protective material to said radially outwardly projecting support members.

2. The combination set forth in claim 1 wherein said radially outwardly projecting support members each include a vertically extending, terminal end portion; said layer of protective material being coupled to said terminal end portion.

3. The combination set forth in claim 1 wherein said upstanding support means includes a plurality of longitudinally spaced, upstanding support legs; said frame means further including longitudinally extending walkway mounting plates mounted on said support means for supporting walkway, laterally extending brace members spanning said longitudinally extending plates, and means coupling said laterally extending brace members to the upper portion of said cylindrical sidewall.

4. The combination set forth in claim 1 wherein said frame means includes perimetrically extending tool retaining edge means extending upwardly above the upper surface of said walkway.

* * * * *